US007054738B1

(12) United States Patent
Stotsky

(10) Patent No.: US 7,054,738 B1
(45) Date of Patent: May 30, 2006

(54) METHOD FOR ESTIMATING ENGINE FRICTION TORQUE

(75) Inventor: Alexander A Stotsky, Göteborg (SE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/252,286

(22) Filed: Oct. 17, 2005

(51) Int. Cl.
*F02D 41/16* (2006.01)

(52) U.S. Cl. ..... 701/115; 701/102; 123/339.19

(58) Field of Classification Search ..... 701/115, 701/102, 110; 123/339.19, 339.22, 339.23, 123/339.24
See application file for complete search history.

(56) References Cited

U.S. PATENT DOCUMENTS

| | | | | |
|---|---|---|---|---|
| 6,176,218 | B1 | 1/2001 | Beechie et al. | |
| 6,188,951 | B1 | 2/2001 | Beechie et al. | |
| 6,553,958 | B1 | 4/2003 | Kolmanovsky et al. | |
| 6,655,353 | B1 * | 12/2003 | Rayl | 123/436 |
| 2003/0100401 | A1 | 5/2003 | Kim | |
| 2003/0183203 | A1 | 10/2003 | Unland et al. | |
| 2004/0068359 | A1 | 4/2004 | Neiss et al. | |
| 2004/0161340 | A1 * | 8/2004 | Rimkus et al. | 417/20 |

OTHER PUBLICATIONS

Stotsky, Alexander, "Adaptive Estimation of the Engine Friction Torque," Feb. 11, 2005, pp. 1-19.

Vahidi, A. et al., "Simultaneous Mass and Time-Varying Grade Estimation for Heavy-Duty Vehicles," Proceedings of the American Control Conference, Denver, CO, Jun. 4-6, 2003, pp. 4951-4956.

Diop, S., et al., "Interpolation and Numerical Differentiation for Observer Design," Proceedings of the American Control Conference, Baltimore, Maryland, Jun., 1994, pp. 1329-1333.

Stotsky, Alexander et al., "Recursive Spline Interpolation Method for Real Time Engine Control Applications," Control Engineering Practice, vol. 12, 2004, pp. 409-416.

Sandoval, D. et al., "An Improved Friction Model for Spark-Ignition Engines," SAE Paper 2003-01-0725.

Rakopoulos, C. et al., "The Effect of Friction Modelling on the Prediction of Turbocharged Diesel Engine Transient Operation," SAE Paper 2004-01-0925.

* cited by examiner

*Primary Examiner*—Hieu T. Vo
(74) *Attorney, Agent, or Firm*—Brooks Kushman P.C.

(57) ABSTRACT

Algorithms for real-time estimation of the engine friction torque in a vehicle powertrain are disclosed. Engine friction torque is estimated at start and at engine idle. Recursive and computationally efficient algorithms allow prediction of friction torque for a wide range of speeds and loads even with few new measured points by taking into account physical dependencies used for adaptation of the sites of the look-up tables (static maps). The algorithms make it possible to avoid drivability problems that could result from errors in estimating engine friction torque.

12 Claims, 5 Drawing Sheets

Fig. 9
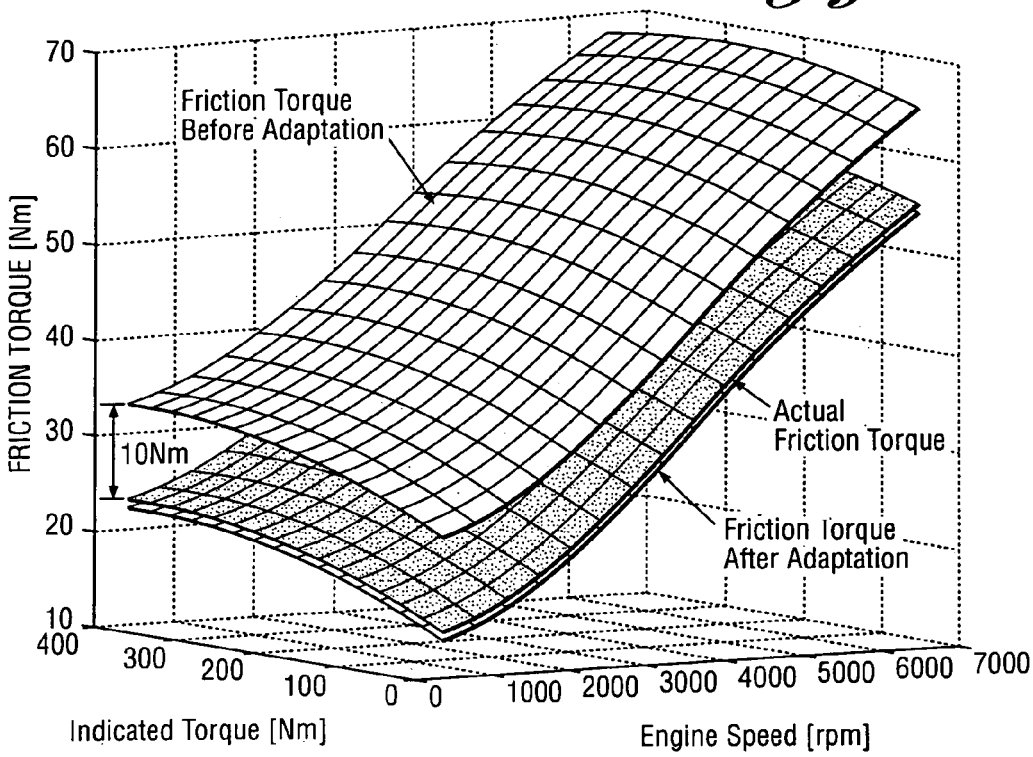
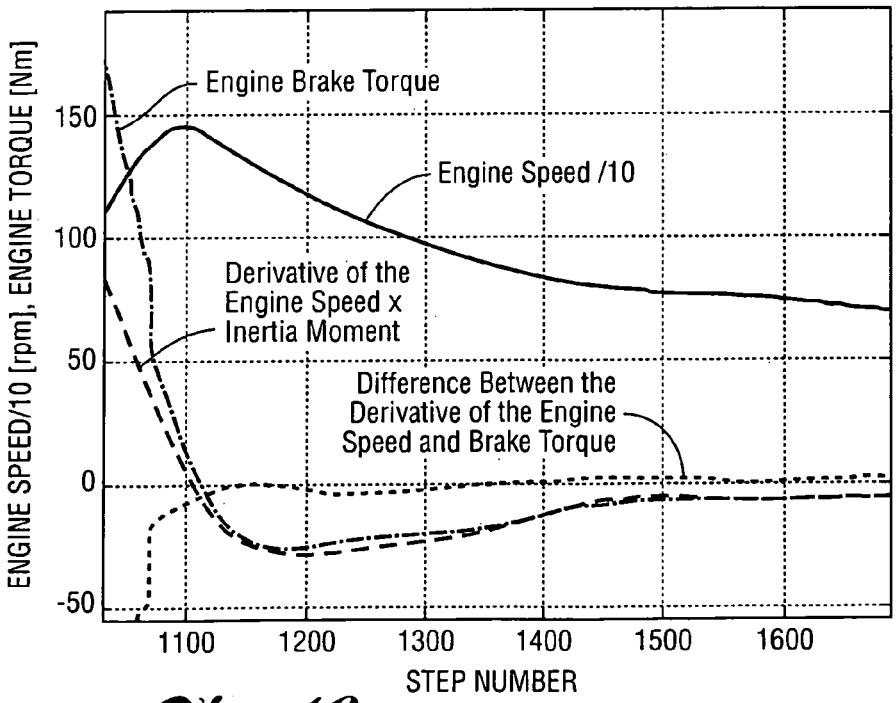
Fig. 10

METHOD FOR ESTIMATING ENGINE FRICTION TORQUE

BACKGROUND OF THE INVENTION

1. Field of the Invention

The invention relates to a method for controlling an internal combustion engine and estimating engine friction torque.

2. Background Art

An error in an estimate of friction torque used in the control of an internal combustion engine in a vehicle powertrain may have a direct effect on drivability performance of a vehicle powered by the engine. The performance depends on the accuracy of an engine torque model. One of the components of the engine torque model is engine friction torque. The values of engine friction torque, which are pre-calibrated, are memorized in a look-up table or static map residing in the memory of an engine controller.

Friction torque is mainly a function of engine speed, engine indicated torque, and engine oil temperature. Variability in engine components may result in variations in the engine friction torque for a given vehicle installation. Further, friction torque variations might not be the same for different vehicles. Friction torque losses, moreover, change with time due to aging of engine components. These variations cause errors in the estimate of friction torque, and thus lead to deterioration of drivability performance.

Because of the foregoing considerations, it is desirable to develop real-time algorithms to improve the accuracy of the engine friction model.

Friction torque can be estimated if load torque is known. Load torque can be estimated by using wheel speed measurements. Unfortunately, load torque depends on vehicle mass and road gradient, which are unknown parameters.

An opportunity for estimating friction is during engine idle, when the engine is decoupled from the driveline, output shaft torque is zero and the transmission is in neutral. The idle state, however, will give an estimate of the friction torque only at idle speed and low indicated torque. All the sites or nodes of the look-up table could be adapted by using new values of the friction torque at idle. However, even small errors in the friction estimation at idle due to errors in accessory loads, for example, could lead to significant errors in the friction estimation at high rotational speeds. Moreover, the friction losses due to aging of the engine components could also change as a function of the engine speed (not only the offset, but also the gradient of the map should be adapted). Therefore, more points for different engine speeds and loads are required for adaptation of a friction look-up table.

SUMMARY OF THE INVENTION

An opportunity for obtaining an accurate engine friction torque estimation, according to the present invention, is the period following engine start. At engine start, the engine speed increases to a relatively high level compared with the idle speed, and then slowly decreases, converging to the desired idle speed. Newton's law for rotational dynamics can be used as a reference model. The difference between the derivative of the engine speed multiplied by the inertia moment and the engine brake torque then can be seen as a deviation from the reference model. If the friction losses are correctly estimated, the deviation from the reference model is close to zero at the interval of interest.

This reference model should be valid during long term engine operation. Any deviation from the reference model at the interval of interest is assumed to be related to the friction losses, since the aging of the engine components first of all affects the friction losses. If a deviation from the reference model is detected, then the friction look-up table is updated so that the deviation is minimized.

The present invention is a model reference adaptive method driven by engine start events. The algorithm used in the present invention can be divided into two parts. The first part is the estimation of the friction losses at engine start and at idle, and the second part is the adaptation of a friction torque look-up table.

In known engine control methods for adapting look-up tables to improve robustness of an engine control, the total engine operating region is divided into several parts and new values are stored for every operating region, thereby forming a new look-up table. Linear interpolation is used for interpolating the values of the table between the regions. However, very often new data are available in the specific regions only. For example, the engine friction torque look-up table is adapted by using new data at low speeds and indicated torques only. If the values of the friction torque are not renewed in other regions, then there could be a big difference between the values of the friction torque in the segment of low speeds and indicated torques and the values of the friction torque in the neighboring segments. The friction torque during a transient from low speeds and indicated torques to higher speeds and indicated torques then would change significantly. This would deteriorate performance of the engine control system, which is based on a torque model. The present invention includes the use of algorithms for the adaptation of the look-up tables that allow a prediction of the values of the friction torque, even for the operating regions with sparse new data representation.

The present invention uses a look-up table of the friction losses as a function of engine speed and indicated torque, which is presented in the form of a manifold in three dimensional space. The shape of the manifold results from a physical dependence of friction torque as a function of speed and indicated torque (the friction increases with speed and indicated torque). If new data are available in a certain operating region only, then a part of each of the manifold coefficients is adapted (for example, the offset and the gradient in the engine speed direction). This determines the shape of the manifold and a prediction of the values in the regions without new data to be maintained.

The invention uses a polynomial approximation of the manifold in the least-squares sense. New data are added with a certain weighting factor to the old data, and a part of the coefficients of the polynomial is updated or adapted in the least-squares sense. Adaptation of the part of the coefficients of the polynomial allows using 'a priori' information present in the nonadaptive part.

In order to reduce the computational burden of the processor of the engine controller, recursive and computationally efficient algorithms are developed. Therefore, the friction torque can be estimated for a wide range of speeds and loads, even with few measured points, by taking into account physical dependencies. These are present in the shape of the manifold.

BRIEF DESCRIPTION OF THE DRAWINGS

FIG. 9 shows three dimensional plots of the friction torques as functions of engine speed and indicated torque, wherein the friction torque before adaptation and after adaptation are plotted as white surfaces and actual friction torque is plotted as a stippled surface.

FIG. 10 is a time plot of engine speed and engine torque, wherein the friction losses have been correctly adapted.

DETAILED DESCRIPTION OF AN EMBODIMENT OF THE INVENTION

Errors in the estimate of engine friction torque have a direct impact on the behavior of the engine speed during negative transients, where the driver releases the accelerator pedal and switches to a neutral gear. The engine speed during negative transients is governed by a torque model. Requested indicated engine torque is calculated from the requested engine brake torque by adding the torque losses (friction and pump losses). The requested engine brake torque is calculated as a function of accelerator pedal position and engine speed. The requested indicated engine torque in the negative transient of the engine speed with overestimated friction losses (real losses are less than estimated), is higher than it would be if friction losses were to be correctly estimated.

The desired engine load is calculated from the desired indicated torque. The feedback load control system regulates the engine load to the desired load, which implies that the actual indicated torque converges to the desired indicated torque. The actual indicated engine torque (which is negative during a negative transient) is higher than it would be if the losses were estimated correctly. Therefore, the engine speed decays slowly. Moreover, overestimation of the friction torque leads not only to slow negative transients of the engine speed, but also to a constant offset in steady-state engine speed with respect to a target idle speed. This offset is present if the engine idle speed controller is not engaged. The idle speed controller is not engaged if the difference between instantaneous speed and the target idle speed is too large or if a certain gear is engaged.

A gear state identification mechanism for vehicles with a manual transmission is based on a comparison of the vehicle speed and the engine speed. If a gear state identification mechanism fails and shows that a certain gear is engaged, but a driver has switched to the neutral gear, then the idle speed control system is not activated.

Figure 2:
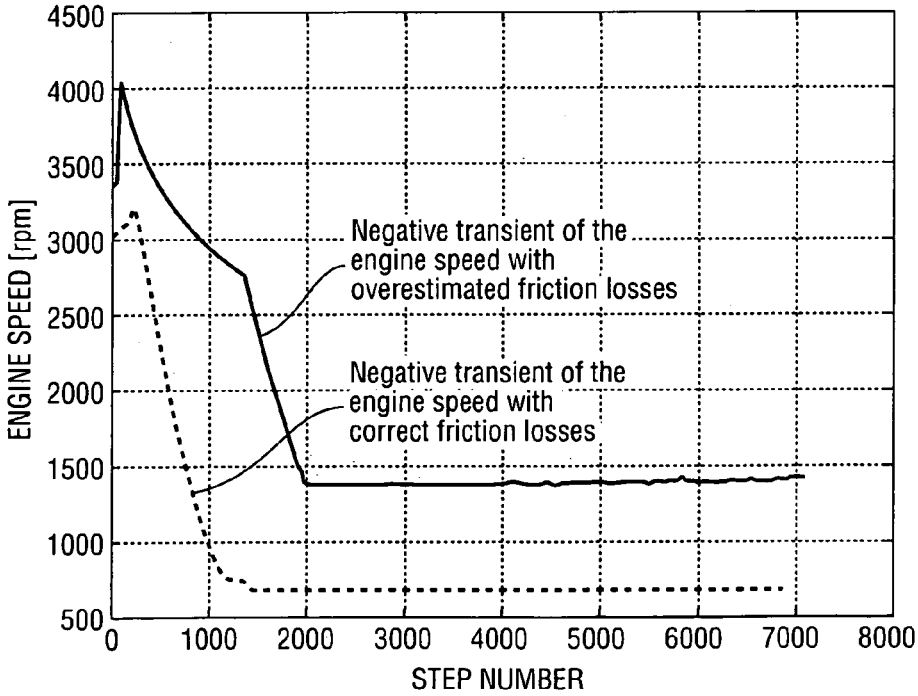
FIG. 2 is a time plot of engine speeds during transients with correct and overestimated friction losses.

A steady-state offset, due to the errors in friction estimation, could result in a vehicle lurch or jerk if a driver engages a low gear. FIG. 2 shows the behavior of the engine speed during a negative transient for the case where the friction losses were overestimated by a constant offset of 15 Nm.

Figure 3:
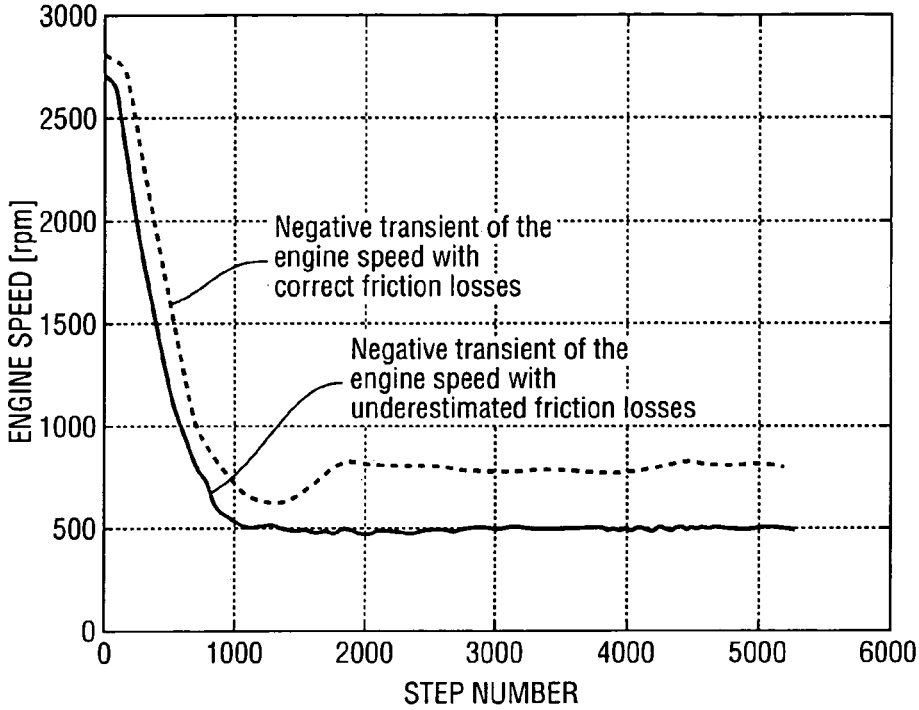
FIG. 3 is a time plot of engine speeds during negative transients of engine speed. Negative transients are driven by the torque model with correct and underestimated friction losses, for purposes of comparison.

FIG. 3 shows the behavior of the engine speed in a negative transient for the case where the friction losses were underestimated (the real losses are higher than estimated) by a constant offset of 10 Nm. If the friction losses are underestimated, then the engine speed converges to very low value, causing a risk for engine stall. Errors in the estimation of the friction losses thus can lead directly to deterioration of drivability performance.

Figure 1:
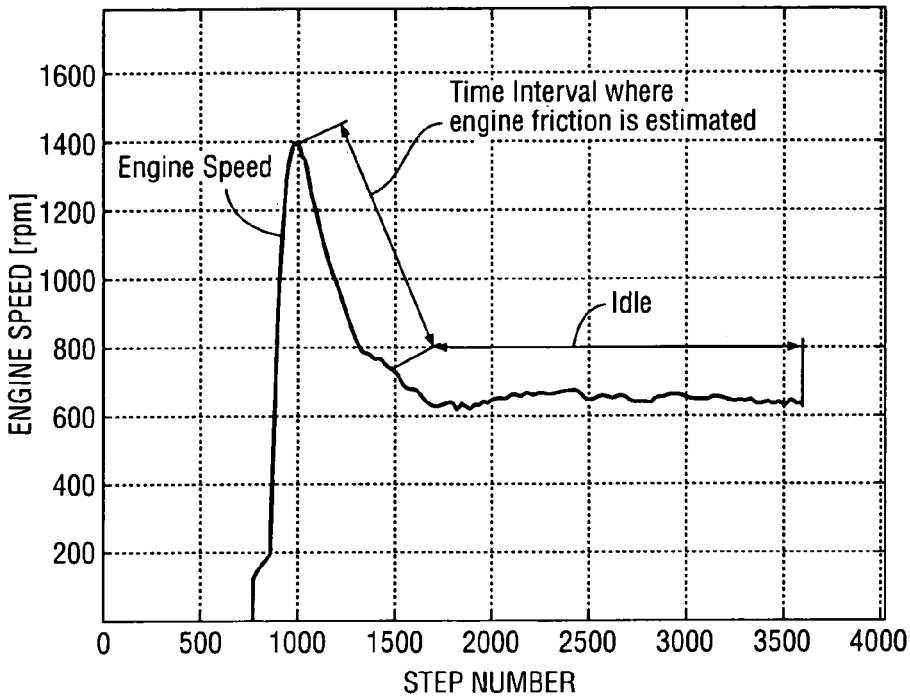
FIG. 1 is a time plot of engine speed during an engine start and during engine idle, wherein the engine speed at engine start increases to a high level and then slowly decreases and converges to a desired idle speed.

The errors in the estimated friction losses, as mentioned previously, have an effect on the behavior of the engine torque at start and at idle. Newton's law $$J\dot{\omega}=T_{brake}-T_{acs} \tag{1}$$

can be seen as a reference model at the interval $[t_i\ t_f]$, where $t_i$ is the time when the engine speed nears a maximum value at start, $t_f$ is the time when the engine speed reaches the desired idle speed (see FIG. 1), ω is the engine speed, J is the inertia moment of the engine, $T_{brake}$ is the engine brake torque, and $T_{acs}$ is the torque corresponding to accessory loads. The engine brake torque is the difference between the engine indicated torque and the torque corresponding to the losses; i.e., $T_{brake}=T_{ind}-T_{loss}$, where $T_{ind}$ is the indicated engine torque, $T_{loss}=T_f+T_p$, and $T_{loss}$ is the torque corresponding to the losses, which in turn is the sum of the friction $T_f$ and the pump losses $T_p$.

For purposes of illustration, assume the following error is introduced:

$$e(t)=J\dot{\omega}=(T_{brake}-T_{acs}) \tag{2}$$

If the torque model is well calibrated, then the absolute values of the error e(t) are close to zero at the interval of interest. Any deviation from the reference model is assumed to be related to the friction losses, since aging of the engine components first of all affects the friction losses. The friction torque is a function of engine speed and indicated engine torque; i.e., $T_f=f(\omega, T_{ind})$. The friction torque is presented as a look-up table with two inputs ω and $T_{ind}$. The sites or nodes of the look-up table should be updated so that the absolute values of the error e(t) is reduced after each start event. The control aim can be presented as follows:

It is necessary to find an adaptation mechanism for adaptation of the sites of the engine friction look-up table such that the following control aim is reached:

$$\overline{\lim_{k\to\infty}}|e(t)|\le\Delta, \tag{3}$$

where k is the number of the start events, and Δ>0 is a small positive constant, $t\in[t_i-t_f]$.

The system, as described, can be seen as a model reference adaptive system driven by the engine start events.

Estimation of friction torque can be solved in two steps. In the first step, the deviation from the engine friction torque, which is pre-calibrated, is calculated for each start event by a comparison of $J\dot{\omega}$ and $T_{brake}-T_{acs}$ at a certain interval. If $J\dot{\omega}$ significantly deviates from $T_{brake}-T_{acs}$, then the number of the actual values of the engine friction torque is computed. The number of the actual values of the engine friction torque as a function of speed and indicated torque is the input to the second step. At the second step, the sites or nodes of the friction torque look-up table are adapted so that the deviation between $J\dot{\omega}$ and $T_{brake}-T_{acs}$ is reduced for the next start event.

Assuming that the engine friction torque can be presented as a sum of two components, $T_{fc}+\Delta T_f$, where $T_{fc}$ is the engine torque calibrated in the rig and $\Delta T_f$ is the deviation from the calibrated torque. The deviation $\Delta T_f$ is calculated by using an error e(t), which is evaluated at certain discrete points $t_p$, (p=1, 2, . . . ), on a time scale, i.e., $$\Delta T_f(w(t_p),T(t_p)_{ind})=e(t_p)-J\dot{\omega})(t_p)+T(t_p)_{ind}-T_{fc}(t_p)-T_p(t_p)-T_{acs}(t_p), \quad (4)$$

where $t_p \epsilon [t_i\ t_f]$. The points on the time scale $t_p$ when $\Delta T_f$ is evaluated should be well separated from each other, providing information about $\Delta T_f$ for different values of the engine speed and indicated torque. From two to four measured points can be obtained during a negative transient. One point is obtained at idle. The deviation from the calibrated engine friction torque at idle $\Delta T_f(w_{id},T_{ind_{id}})$, where $w_{id}$ is the idle engine speed and $T_{ind_{id}}$ is the indicated torque at idle, is calculated as follows:

$$\Delta T_f(w_{id},\ T_{ind_{id}})=T_{ind_{id}}-T_{fid}-T_{Pid}-T_{acs_{id}} \quad (5)$$

where $T_{fid}$, $T_{Pid}$ and $T_{acs_{id}}$ are the values of friction torque, pump torque and the torque corresponding to the accessory loads, respectively. If the engine is idling for a relatively long period, the deviation $\Delta T_f$ is averaged over a certain number of steps, providing a consistent estimate for the deviation $\Delta T_f(w_{id},\ T_{ind_{id}})$.

For the calculation $\Delta T_f(w(t_p),T(t_p)_{ind})$ according to (4) during a start, the estimate of the derivative of the engine speed is necessary. The backward difference method, which is widely used for calculation of the derivative of the signal, often gives very noisy estimates. For the improvement of the quality of the estimate of the derivative of the engine speed signal, a spline interpolation method is used. A spline interpolation method is based on on-line least-squares polynomial fitting over a moving-in-time window of a certain size. The advantage of this method over the backward difference method is its good transient behavior. The idea for the spline interpolation method is to fit a polynomial of a certain order as a function of time in the least-squares sense and to take the derivatives analytically. Since the sites of the friction look-up table are adapted after the engine start events, a post-processing of the signals is allowed; i.e., the signals are memorized and processed offline.

The spline interpolation method gives an accurate estimate of the derivative of the engine speed during post-processing since the derivative of the engine speed is computed in the middle of a moving window. This technique improves essentially the quality of the engine speed derivative signal. Other signals in (4) should also be delayed.

An example of a method for determining a variation of an engine parameter by interpolation of a polynomial is disclosed in European patent EP 1462638, issued to Alexander Stotsky and Attila Forgo and assigned to the assignee of the present invention.

Figure 4:
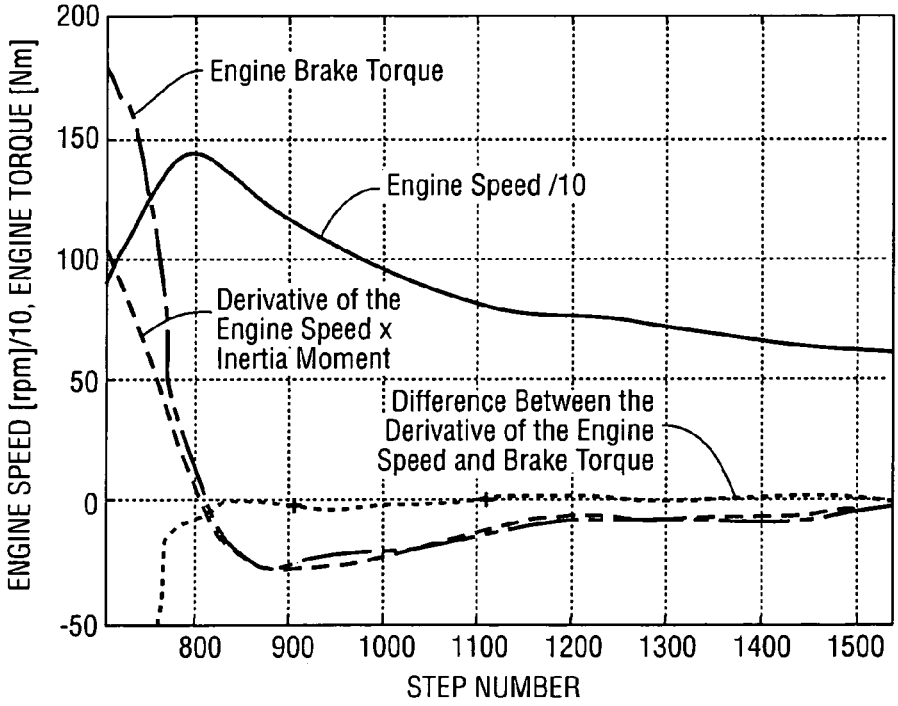
FIG. 4 is a time plot of engine speed, the derivative of engine speed multiplied by the inertia moment, and engine brake torque, wherein the friction losses are correctly estimated.

FIG. 4 shows the behavior of engine speed, together with its derivative and engine brake torque during a start. The derivative of the engine speed is computed by using the spline interpolation method with a window size of 250 steps (each step is 4 ms). The derivative was computed in the middle of the moving window. The friction losses are correctly estimated, and the difference $e(t)=J\dot{\omega}-T_{brake}$, which is plotted with a dotted line, is close to zero in the interval where engine speed decreases. Since the second step of the algorithm has a discrete input, the values of e(t) are evaluated at two points indicated with plus signs.

Figure 5:
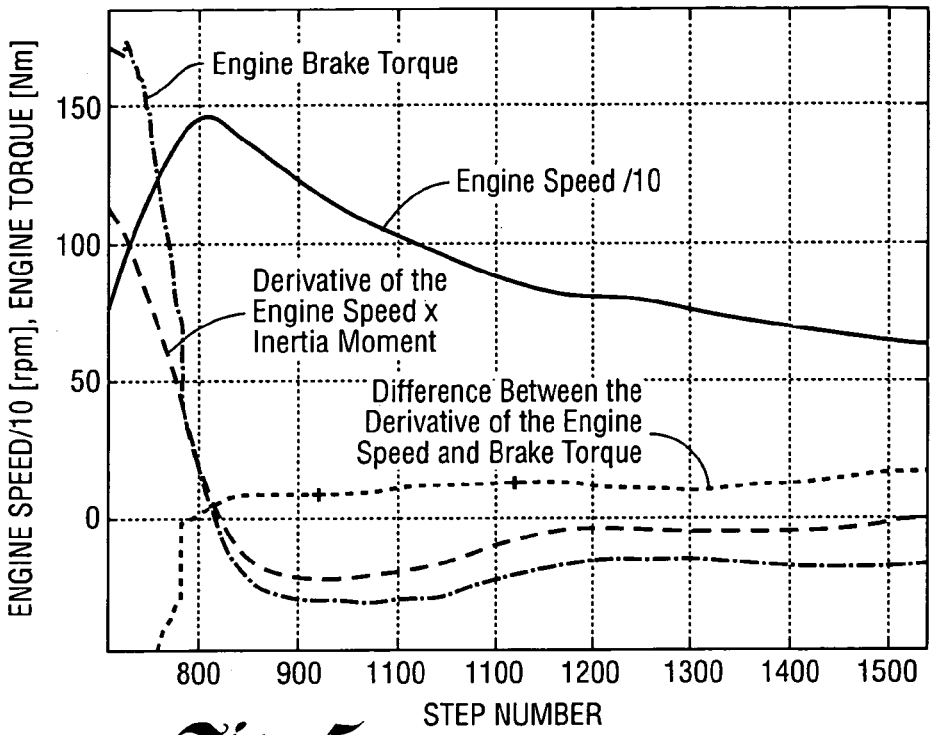
FIG. 5 is a time plot, corresponding to the plot of FIG. 4, showing engine speed, derivative of engine speed multiplied by inertia moment, and engine brake torque when the friction losses are overestimated.
Figure 6:
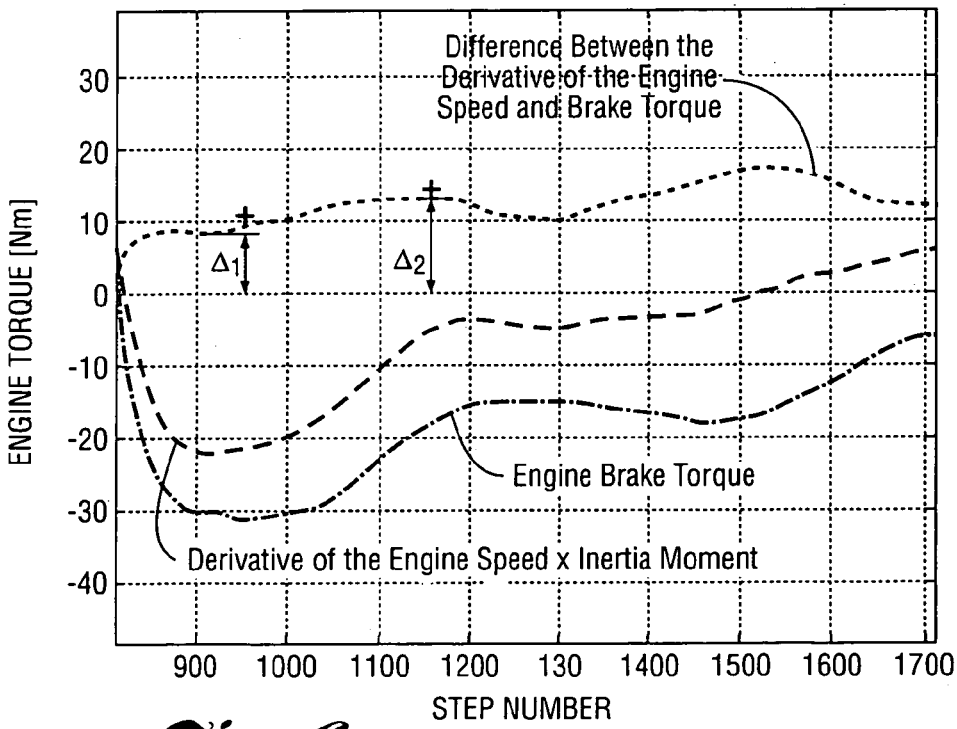
FIG. 6 is a time plot of the derivative of engine speed multiplied by the inertia moment, and engine brake torque. It corresponds to the plot of FIG. 5, wherein the friction losses are overestimated.

FIGS. 5 and 6 show the behavior of the engine speed and brake torque during a start where the friction losses are overestimated; i.e., $\Delta T_f$=10 [Nm]. FIG. 5 shows the difference between $J\dot{\omega}$ (dashed line) and engine brake torque (dashdot line). The difference is plotted with a dotted line. The points where $\Delta T_f$ is calculated are shown with plus signs. The deviations from the calibrated friction losses $\Delta T_f$ as a function of engine speed and indicated torque are the inputs for adaptation algorithms, to be described subsequently. As can be seen from FIG. 6, the deviations $\Delta T_f$ are estimated with some errors. For each deviation $\Delta T_f$, a weight, which indicates the consistency of the point, is assigned. As can be seen from the FIGS. 5 and 6, two points are available for adaptation of the friction losses. The third point for calculation $\Delta T_f$ is available when the engine is idling. The deviation $\Delta T_f$ at idle is averaged over a certain number of steps, providing a consistent estimate. Therefore, the weight for the deviation $\Delta T_f$ at idle is chosen higher, since engine idle conditions provide a more consistent estimate of $\Delta T_f$ than engine start conditions.

In FIG. 4, the friction losses are correct. The engine speed at start is plotted with a solid line. The values of the engine speed are divided by ten. Engine brake torque is plotted with a dashdot line. The derivative of the engine speed multiplied by the inertia moment $J\dot{\omega}$ is plotted with a dashed line. The difference $e(t)=J\dot{\omega}-T_{brake}$ is plotted with a dotted line. The points where $e(t_p)$ is evaluated are indicated with plus signs.

In FIG. 5, the friction losses are overestimated by 10 [Nm]. Engine speed at start is plotted with a solid line. The values of the engine speed are divided by ten. Engine brake torque is plotted with a dashdot line. The derivative of the engine speed multiplied by the inertia moment $J\dot{\omega}$ is plotted with a dashed lined. The difference $e(t)=J\dot{\omega}-T_{brake}$ is plotted with a dotted line. The points where $e(t_p)$ is evaluated are indicated with plus signs.

In FIG. 6, the friction losses are overestimated by 10 [Nm]. Engine brake torque is plotted with a dashdot line. The derivative of the engine speed multiplied by the inertia moment $J\dot{\omega}$ is plotted with a dotted line. The points where $e(t_p)$ is evaluated are indicated with plus signs, where the differences are $\Delta_1$ and $\Delta_2$. The left point is evaluated at $\omega$=1180 [rpm], $T_{ind}$=23 [Nm], and the right point is evaluated at $\omega$=860 [rpm], $T_{ind}$=42 [Nm]. The friction torque at idle is evaluated at $\omega$=650[rpm], $T_{ind}$=34 [Nm].

Figure 7:
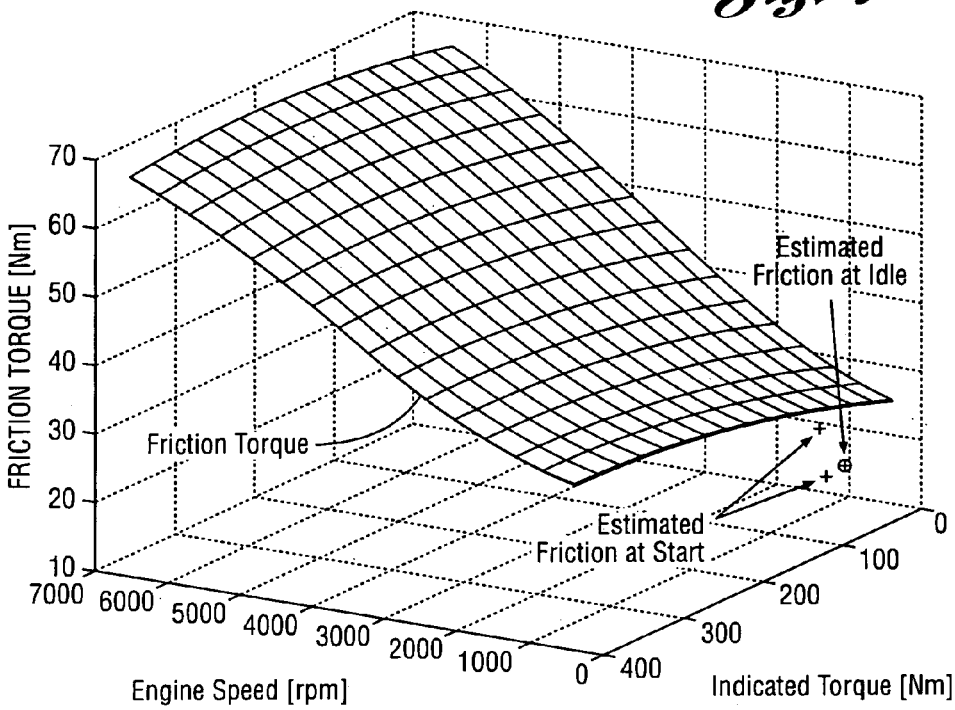
FIG. 7 is a three dimensional plot showing engine friction torque as a function of engine speed and indicated engine torque, wherein the friction torque is overestimated.

The next step is to present algorithms for adaptation of the friction torque look-up table. FIG. 7 shows a three dimensional plot of the friction torque with an overestimated offset of 10 Nm. Two points obtained at engine start and a third point obtained at engine idle are shown with plus signs. The point obtained at idle is shown with a round sign added.

The adaptive problem statement is the following: It is necessary to design an adaptation algorithm for the sites or nodes of the look-up table by using three measured points of the actual friction torque.

Figure 8:
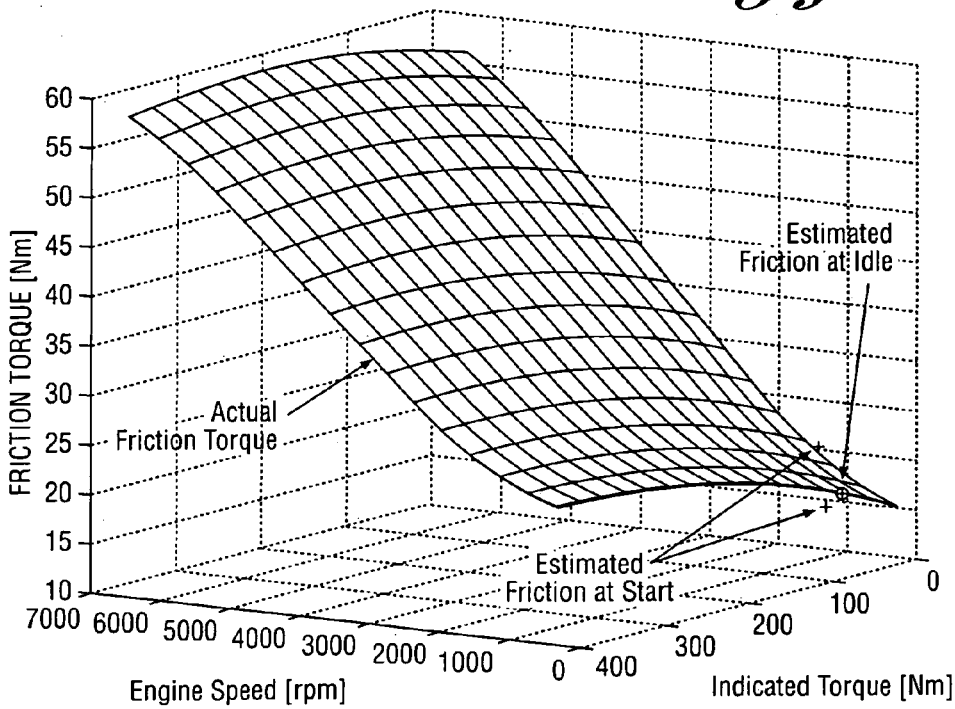
FIG. 8 is a three dimensional plot of actual engine friction torque as a function of engine speed and indicated engine torque.

FIG. 8 shows the relation between the actual engine friction torque (three dimensional manifold) and the estimated friction at engine start (two points plotted with plus signs) and the friction torque estimated at engine idle plotted with plus sign in a round sign. As can be seen from FIG. 8, the values of the friction torque evaluated at engine start are located above the surface and below the surface, while a value of the engine torque estimated at engine idle is located precisely on the surface. As indicated above, the estimation of the engine friction torque at engine start provides less consistent estimates than estimates of the friction torque at engine idle. Therefore, the measurements of the friction torque at idle and at start should be treated differently by assigning different weights in the adaptation algorithms.

In FIG. 7, engine friction torque is plotted as a function of the engine speed and indicated engine torque. The friction torque is overestimated by 10 [Nm]. Two points representing the estimated friction torque from the start (see FIGS. 5 and 6) are plotted with plus signs. The point that represents the estimated friction torque at idle is plotted with round and plus signs.

In FIG. 8, actual engine friction torque is plotted as a function of the engine speed and indicated engine torque. Two points representing the estimated friction torque from the start (see FIGS. 5 and 6) are plotted with plus signs. The point that represents the estimated friction torque at idle is plotted with round and plus signs.

The algorithm of the adaptation of the sites or nodes of two dimensional tables can be divided into three steps. In the first step, the look-up table is approximated by a polynomial of two independent variables in the least-squares sense. In the second step, a recursive procedure is designed for adaptation of the coefficients of the polynomial when new data are added. In the third step of the algorithm, the approximation error is canceled. Namely, the differences between the polynomial approximation of the original table and polynomial after adaptation are evaluated at every site or node and added to original look-up table. This allows a cancellation of the approximation error and usage of low order polynomials, which are more robust with respect to measurement errors. Only the sites or nodes of the look-up table are adapted as a result of the application of the algorithm described above. The values of the friction torque between the sites or nodes are obtained by linear interpolation.

For purposes of illustration, let it be assumed that there is a look-up table describing the variable z as a function of two variables x and y. The look-up table is presented as a number of nodes ($x_h$, $y_p$), h=1, . . . , D, and p=1, . . . , G where the output variable $z_{h,p}$ is defined. The values of the variable z between the nodes are computed via a linear interpolation. The problem of the adaptation of a look-up table is reduced to the adaptation of $z_{h,p}$.

As mentioned above, the problem can be solved in three steps as follows:

Step 1. Polynomial Approximation.

In this step, the look-up table is approximated by the following polynomial:

$$\hat{z} = \sum_{i=0}^{n} \sum_{j=0}^{n} a_{i,j} x^i y^j, \tag{6}$$

where n is the order of the polynomial, $a_{i,j}$ are the coefficients of the polynomial. The polynomial model (6) can be written in the following form:

$$\hat{z} = \phi^T \theta, \tag{7}$$

where $$\theta = [1, y, y^2, \ldots, y^n, x, xy, xy^2, \ldots, xy^n, \ldots, x^n, x^n y, x^n y^2, \ldots, x^n y^n]^T \tag{8}$$

is the regressor and $$\phi = [\alpha_{00}, \alpha_{01}, \alpha_{02}, \ldots, \alpha_{0n}, \alpha_{10}, \alpha_{11}, \alpha_{12}, \ldots, \alpha_{1n}, \ldots, \alpha_{n0}, \alpha_{n1}, \alpha_{n2}, \ldots, \alpha_{nn}]^T \tag{9}$$

is the parameter vector.

The performance index to be minimized is expressed as follows:

$$S = \sum_{l=1}^{N} (z_l - \hat{z}_l)^2 w_l, \tag{10}$$

where N is the number of the sites (nodes) of the look-up table, and l=1, . . . , N,N=D×G, and $\omega_l$ is the weight at every node of the table. The parameter θ, which minimizes the index (10), can be computed as follows:

$$\theta = \left[\sum_{l=1}^{N} (\varphi_l \varphi_l^T w_l)\right]^{-1} \sum_{l=1}^{N} z_l \varphi_l w_l. \tag{11}$$

For purposes of illustration, let it be assumed that the parameter vector θ has been computed according to the formula (11) and memorized in the memory of the electronic control unit. Then, the problem of the adaptation of the look-up table can be stated as the problem of the adaptation of the parameter vector θ for new measured data. The values $\hat{z}_{(h\,p)}$ of the look-up table at all the sites ($x_h$, $y_p$) are computed according to equation (7).

Step 2. Adaptation of the Coefficients.

In this step of the algorithm, the vector θ is adapted for new data. Suppose that new measured data $x_m$, $y_m$, $z_m$ with the weight $w_m$ are added to the data set. The parameter vector $\theta \epsilon R^{(n+1)_2}$ is divided into two parts: the first part $\theta^c \epsilon R^{(n+1)_2 - q}$ remains unchanged from the previous step, and the second part $\theta_\alpha \epsilon R^q$ should be adapted, where q is the number of parameters to be adapted. Then, $$\theta = [\theta_c \theta_\alpha]^T \text{ and} \tag{12}$$

$$\phi = [\phi_c \phi_\alpha]^T, \tag{13}$$

where $\phi_c$ is the part of the regressor, which corresponds to the parameter vector $\theta_c$, and $\phi_a$ is the part of the regressor corresponding to the parameter vector $\phi_a$. New measured data $x_m$, $y_m$, and $z_m$ are added to the data set. The performance index to be minimized is the following:

$$S_1 = \sum_{l=1}^{N} (z_l - \hat{z}_l)^2 w_l + (z_m - \varphi_m^T \theta)^2 w_m, \tag{14}$$

where $$\phi_m = [1, y_m, y_m^2, \ldots, y_m^n, x_m, x_m y_m, x_m y_m^2, \ldots, x_m y_m^n, \ldots, x_m^n, x_m^n y_m, x_m^n, \ldots, x_m^n y_m^n]^T, \tag{15}$$

and $$\phi_m = [\phi_{cm} \phi_{\alpha m}]^T. \tag{16}$$

The adaptive parameter $\theta_a$ is computed according to the following equation $$\frac{\partial S_1}{\partial \theta_a} = 0;$$

i.e., $$\theta_a = \left[\sum_{l=1}^{n} (\varphi_{al}\varphi_{al}^T w_l + \varphi_{am}\varphi_{am}^T w_m\right]^{-1} * \sum_{l=1}^{N} (z_l - \varphi_{cl}^T\theta_c)\varphi_{al}^T w_l + (z_m - \varphi_{cm}^T\theta_c\varphi_{am}^T)w_m. \tag{17}$$

In order to reduce the computational burden on the engine controller, the adjustable parameter is computed recursively. The vector of the adjustable parameters is computed according to the following formula at step (k−1):

$$\theta_{a(k-1)} = \left[\sum_{l=1}^{N} (\varphi_{al}\varphi_{al}^T w_l)\right]^{-1} \sum_{l=1}^{N} (z_l - \varphi_{cl}^T\theta_c)\varphi_{al}^T w_l; \tag{18}$$

and the adjustable parameter $\theta_{ak}$ at step k should be updated recursively using $\theta_{a(k-1)}$ as soon as new data $z_m$, $\phi_m$ with the weight $w_m$ are available. Applying the matrix inversion relation to equation (17) and taking into account equation (18), one gets the following adjustment law for the parameter $\theta_{ak}$ at step k:

$$\theta_{ak} = \left[I - \frac{\Gamma_{k-1} w_m \varphi_{am}\varphi_{am}^T}{(1 + w_m\varphi_{am}^T\Gamma_{k-1}\varphi_{am})}\right](\theta_{a(k-1)} + \Gamma_{k-1}(z_m - \varphi_{cm}^T\theta_c)w_m\varphi_{am}^T), \tag{19}$$

$$\Gamma_k = \Gamma_{k-1} - \frac{w_m\Gamma_{k-1}\varphi_{am}\varphi_{am}^T\Gamma_{k-1}}{(1 + w_m\varphi_{am}^T\Gamma_{k-1}\varphi_{am})}, \tag{20}$$

where $\Gamma_{k-1}=[\Sigma_{l=1}^{N}(\phi_{al}\phi_{al}^T\omega_l)]^{-1}$, and I is a q×q identity matrix and the following condition for convergence of the algorithm imposes restrictions on the weights:

$$-\Gamma_{k-1} < \Gamma_{k-1} - \frac{w_m\Gamma_{k-1}\varphi_{am}\varphi_{am}^T\Gamma_{k-1}}{(1 + w_m\varphi_{am}^T\Gamma_{k-1}\varphi_{am})} < \Gamma_{k-1}. \tag{21}$$

The algorithm (20) is easily implemented since the dimension of the vector $\theta_a$ is low. As a rule, only the offset and the slope in one of the directions are updated; i.e., q=2.

The values $\hat{z}_{\alpha(h,p)}$ of the table at all the sites $(x_h, y_p)$ are computed according to the following formula:

$$\hat{z}_{\alpha k} = \phi_{ck}^T\theta_c + \phi_{\alpha k}^T\theta_{\alpha k}. \tag{22}$$

The vector $\theta_c$ is not updated. That, in turn, allows the shape of the manifold to be maintained.

Step 3. Cancellation of the Approximation Error.

As a result of the application of the algorithm, only the sites of the look-up table are updated. The values of the friction torque between the sites are calculated by linear interpolation. Usually low order polynomials (6) are used for linear approximation. Low order polynomials are more robust with respect to the measurement noise than the polynomials of a high order.

Approximation of a look-up table using low order polynomials, however, could also give a relatively large approximation error. In order to cancel the approximation error, the following differences $\hat{z}_{\alpha(h,p)}-\hat{z}_{(h,p)}$ between the polynomial approximation of the adapted table and the polynomial approximation of the original table are computed at every node h=1, . . . , D, p=1, . . . , G and are added to the values $z_{(h,p)}$ of the original look-up table. Namely, the values of the friction torque at the sites of the look-up table are adapted as follows:

$$\hat{z}_{f(h,p)} = \hat{z}_{(h,p)} + (\hat{z}_{\alpha(h,p)} - \hat{z}_{(h,p)}). \tag{23}$$

In other words, the approximation error that is present in the $\hat{z}_{\alpha(h,p)}$ and $\hat{z}_{(h,p)}$, is canceled since only the difference $(\hat{z}_{\alpha(h,p)}-\hat{z}_{(h,p)})$, not the absolute value, is used for adaptation of the nodes of the look-up table.

Adaptation algorithms described above were applied to adaptation of two dimensional look-up tables for purposes of illustration only. The algorithms can be generalized, however, for a multi-dimensional case where the dimension of the look-up table is higher than two. This can be done without departing from the scope of the invention.

An example of an adaptation of the friction torque look-up table now will be discussed. Suppose that the engine friction torque is overestimated with an offset of 10 [Nm]. Actual values (two values) of the engine friction torque as a function of speed and indicated torque are obtained during an engine start (see FIGS. 5 and 6). A third value of the friction torque is obtained at idle by averaging the values of the friction torque over a certain interval. Weights are assigned to all the values of the measured engine friction torque. The algorithm described above is applied for adaptation of the friction look-up table.

The order of the approximating polynomial is two. Only the offset parameter $a_{00}$ was adapted. The result is plotted in FIG. 9. The friction torques before and after adaptation were plotted with white surfaces, and an actual friction torque is plotted with a gray surface. The difference between actual friction torque and the friction torque after the adaptation is 0.77 Nm.

The look-up table for the friction torque was updated in an electronic control unit for the engine, and the measurements of engine speed and brake torque at engine start are plotted in FIG. 10. The behavior of the engine speed and engine torque before adaptation is plotted in FIG. 5. Comparison of the FIGS. 5 and 10 shows that the error $e(t)=J\dot{\omega}-T_{brake}$ is reduced and the control aim (3) is reached with sufficiently small Δ.

FIG. 10 shows that friction losses have been correctly adapted. Engine speed at start is plotted with a solid line. The values of the engine speed are divided by ten. Engine brake torque is plotted with a dashdot line. The derivative of the engine speed multiplied by the inertia moment $J\dot{\omega}$ is plotted with a dashed line. The difference $e(t)=J\dot{\omega}-T_{brake}$ is plotted with a dotted line.

Although an embodiment of the invention has been disclosed, it will be apparent to persons skilled in the art that modifications may be made without departing from the scope of the invention. All such modifications and equivalents thereof are intended to be covered by the following claims.

What is claimed:

1. A method for estimating friction torque in an internal combustion engine having an electronic controller with repetitive control loops, the controller having memory storage registers that provide residence for a look-up table, the look-up table being characterized by at least two input variables, the method comprising the steps of:

determining a reference model of engine friction torque using calibrated engine friction torque data following an engine start event before engine idle is achieved;

determining a deviation of engine friction torque from the reference model to estimate actual friction torque; and adapting sites in the look-up table if the estimated engine friction torque determined in a current engine start event differs from estimated engine friction torque determined in a preceding engine start event.

2. A method for estimating friction torque in an internal combustion engine having an electronic controller with repetitive control loops, the controller having memory storage registers that provide residence for a look-up table, the look-up table being characterized by at least an engine speed input variable and an indicated engine torque variable, the method comprising the steps of:

determining a reference model of engine friction torque using calibrated engine friction torque data following an engine start event before engine idle is achieved;

determining an estimated engine friction torque using current engine speed and indicated engine torque as variables;

determining a deviation of engine friction torque from the reference model based on the current engine speed and indicated engine torque variables; and adapting sites in the look-up table if the estimated engine friction torque determined in a current engine start event differs from estimated engine friction torque determined in a preceding engine start event.

3. The method set forth in claim 2 wherein an adaptive algorithm for the look-up table comprises a recursive adaptation algorithm for sites in the look-up table, and adapting the sites in the look-up table by using two or more values of estimated engine friction torque at engine start and an additional value of estimated engine friction torque when engine idle is achieved.

4. The method set forth in claim 3 wherein the value of estimated engine friction torque at the time engine idle is achieved is modified and weighted in favor of idle friction torque by assigning different weights in the adaptation algorithm to estimated friction torque at engine idle and to estimated friction torque at engine start.

5. The method set forth in claim 4 wherein the look-up table defines a manifold for engine friction torque in three dimensional space with engine speed and indicated torque as independent variables, whereby the shape of the manifold reflects physical dependencies of the friction torque as a function of speed and indicated torque;

adaptation of the look-up table being associated with a motion of the manifold in three dimensional space, the position and the orientation of the manifold in three dimensional space thereby changing after adaptation, which in turn allows for a prediction of friction torque for a wide range of speeds and indicated torques even with few new measured points by taking into account physical dependencies present in the shape of the manifold, the adaptation algorithm being constructed so that only the sites of the look-up table are adapted, the values of engine friction torque between the sites being computed using interpolation.

6. The method set forth in claim 4 wherein the output of the look-up table is approximated using the polynomial:

$$\hat{z} = \sum_{i=0}^{n} \sum_{j=0}^{n} a_{i,j} x^i y^j, \tag{6}$$

where n is the order of the polynomial, and $a_{i,j}$ are the coefficients of the polynomial, or:

$$\hat{z} = \phi^T \phi, \tag{7}$$

where $$\phi = [1, y, y^2, \ldots, y^n, x, xy, xy^2, \ldots, xy^n, \ldots, x^n, x^n y, x^n y^2, \ldots, x^n y^n]^T \tag{8}$$

is a regressor and $$\theta = [\alpha_{00}, \alpha_{01}, \alpha_{02}, \ldots, \alpha_{0n}, \alpha_{10}, \alpha_{11}, \alpha_{12}, \ldots, \alpha_{1n}, \ldots, \alpha_{n0}, \alpha_{n1}, \alpha_{n2}, \ldots, \alpha_{nn}]^T \tag{9}$$

is a parameter vector.

7. The method set forth in claim 6 wherein parameter vectors are defined by minimizing a performance index using the equation:

$$S = \sum_{l=1}^{N} (z_l - \hat{z}_l)^2 w_l, \tag{10}$$

where N is the number of the sites of the look-up table, l=1, . . . , N, N=D×G, and $\omega_l$ is the weight at every site of the look-up table; and determines the parameter vector θ, which minimizes the performance index, using the relationship:

$$\theta = \left[ \sum_{l=1}^{N} (\varphi_l \varphi_l^T w_l) \right]^{-1} \sum_{l=1}^{N} z_l \varphi_l w_l. \tag{11}$$

8. The method set forth in claim 3 wherein the look-up table defines a manifold for engine friction torque in three dimensional space with engine speed and indicated torque as independent variables, whereby the shape of the manifold reflects physical dependencies of the friction torque as a function of speed and indicated torque;

adaptation of the look-up table being associated with a motion of the manifold in three dimensional space, the position and the orientation of the manifold in three dimensional space thereby changing after adaptation, which in turn allows for a prediction of friction torque for a wide range of speeds and indicated torques even with few new measured points by taking into account physical dependencies present in the shape of the manifold, the adaptation algorithm being constructed so that only the sites of the look-up table are adapted, the values of engine friction torque between the sites being computed using interpolation.

9. The method set forth in claim 8 wherein the parameter vector, which can be expressed as $\theta \epsilon R^{(n+1)_2}$, is updated for new measured data $x_m$, $y_m$ and $z_m$ with weight data $w_m$ and divided into two parts, the first part, which remains unchanged, being expressed as $\theta_c \epsilon R^{(n+1)_2 - q}$ and the second part, which is adapted, being expressed as $\theta_a \epsilon R^q$ where q is the number of parameters to be adapted;

the two parts being expressed as: $\theta=[\theta_c\theta_a]^T$ and $\phi=[\phi_c\phi_a]^T$, where $\phi_c$ is the part of a regressor corresponding to the parameter vector $\theta_c$ and $\phi_a$ is the part of the regressor corresponding to the parameter vector $\theta_a$;

adding the new measured data $x_m$, $y_m$ and $z_m$ to a new data set;

minimizing the following performance index:

$$S_1 = \sum_{l=1}^{N} (z_l - \hat{z}_l)^2 w_l + (z_m - \varphi_m^T\theta)^2 w_m, \tag{14}$$

where $$\phi_m=[1, y_m, y_m^2, \ldots y_m^n, x_m, x_m y_m, x_m y_m^2, \ldots, x_m y_m^n, \ldots, x_m^n, x_m^n y_m, x_m^n, \ldots, x_m^n y_m^n]^T \tag{15}$$

and $$\phi_m=[\phi_{cm}\phi_{am}]^T; \text{ and} \tag{16}$$

computing the adaptive parameter $\theta_a$ in accordance with the equation $$\frac{\partial S_1}{\partial \theta_a} = 0,$$

or $$\theta_a = \left[\sum_{l=1}^{n} (\varphi_{al}\varphi_{al}^T)w_l + \varphi_{am}\varphi_{am}^T w_m\right]^{-1} * \sum_{l=1}^{N} (z_l - \varphi_{cl}^T\theta_c)\varphi_{al}^T w_l + (z_m - \varphi_{cm}^T\theta_c\varphi_{am}^T)w_m. \tag{17}$$

10. The method set forth in claim 9 wherein the adaptive parameter $\theta_a$ is computed recursively, the vector of the adaptive parameter being determined in accordance with the following equation at step (k−1):

$$\theta_{a(k-1)} = \left[\sum_{l=1}^{N} (\varphi_{al}\varphi_{al}^T w_l)\right]^{-1} \sum_{l=1}^{N} (z_l - \varphi_{cl}^T\theta_c)\varphi_{al}^T w_l, \tag{18}$$

the adaptive parameter $\theta_{ak}$ at step k being updated recursively as $\theta_{a(k-1)}$ when new data $Z_m$, $\phi_m$ with weight $w_m$ are available;

applying a matrix inversion relation to equation (17), while taking into account equation (18), to obtain the following adjustment law for adaptive parameter $\theta_{ak}$ at step k as follows:

$$\theta_{ak} = \left[I - \frac{\Gamma_{k-1} w_m \varphi_{am}\varphi_{am}^T}{(1 + w_m\varphi_{am}^T\Gamma_{k-1}\varphi_{am})}\right](\theta_{a(k-1)} + \Gamma_{k-1}(z_m - \varphi_{cm}^T\theta_c)w_m\varphi_{am}^T), \tag{19}$$

$$\Gamma_k = \Gamma_{k-1} - \frac{w_m\Gamma_{k-1}\varphi_{am}\varphi_{am}^T\Gamma_{k-1}}{(1 + w_m\varphi_{ma}^T\Gamma_{k-1}\varphi_{am})}, \tag{20}$$

where $\Gamma_{k-1}=[\Sigma_{l=1}^{N}(\phi_{al}\phi_{al}^T w_l)]^{-1}$ and I is a q×q identity matrix, and the following condition for an algorithm convergence:

$$-\Gamma_{k-1} < \Gamma_{k-1} - \frac{w_m\Gamma_{k-1}\varphi_{am}\varphi_{am}^T\Gamma_{k-1}}{(1 + w_m\varphi_{am}^T\Gamma_{k-1}\varphi_{am})} < \Gamma_{k-1} \tag{21}$$

imposes restrictions on the weights, thereby reducing a computational burden on the controller in obtaining the adaptive parameter; and computing a value $\hat{z}_{a(h,p)}$ at the sites $(x_h, y_p)$ in the look-up table in accordance with the following formula:

$$\hat{z}_{ak}\phi_{ck}^T\theta_c+\phi_{ak}^T\theta_{ak}, \tag{22}$$

whereby the shape of the manifold remains unchanged following adaptation.

11. The method set forth in claim 10 including the step of cancelling an approximation error by computing the following differences $\hat{z}_{a(h,p)}-\hat{z}_{(h,p)}$ between a polynomial approximation of the adapted table and a polynomial approximation of the original look-up table at every site h=1, . . . , D, p=1, . . . , G and adding to the values $z_{(h,p)}$ of the original look-up table;

the values of the engine friction torque at the sites of the look-up table thereby being adapted in accordance with the equation:

$$z_{f(h,p)}=z_{(h,p)}+(\hat{z}_{a(h,p)}-\hat{z}_{(h,p)}), \tag{23}$$

approximation errors present in $\hat{z}_{a(h,p)}$ and $\hat{z}_{(h,p)}$ due to usage of the difference $\hat{z}_{a(h,p)}-\hat{z}_{(h,p)}$ thereby being cancelled;

the values of friction torque between the sites being computed using interpolation.

12. A method for estimating friction torque in an internal combustion engine having an electronic controller with repetitive control loops, the controller having memory storage registers that provide residence for algorithms in the form of a look-up table, the look-up table being characterized by at least an engine speed input variable and an indicated engine torque variable, the method comprising the steps of:

measuring engine speed during an engine start event;

measuring engine speed during an engine idle state following an engine start event;

determining a reference model of engine friction torque using calibrated engine friction torque data based on indicated torque and measured engine speed at the time of an engine start event and an indicated torque and measured engine idle speed at the time engine idle is achieved;

determining an estimated engine friction torque during a time interval between an engine start event and the time engine idle is achieved using current engine speed and indicated engine torque variables;

determining a deviation of engine friction torque from the reference model based on current engine speed and indicated engine torque variables; and adapting sites in the look-up table if the estimated engine friction torque determined in a current engine start event differs from estimated engine friction torque determined in a preceding engine start event.

* * * * *